US010923033B2

(12) United States Patent
Wang et al.

(10) Patent No.: US 10,923,033 B2
(45) Date of Patent: Feb. 16, 2021

(54) PIXEL CIRCUITRY, METHOD FOR DRIVING THE SAME AND DISPLAY DEVICE

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Zhichong Wang, Beijing (CN); Fuqiang Li, Beijing (CN); Jing Feng, Beijing (CN); Peng Liu, Beijing (CN); Xinglong Luan, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/600,908

(22) Filed: Oct. 14, 2019

(65) Prior Publication Data

US 2020/0243013 A1 Jul. 30, 2020

(30) Foreign Application Priority Data

Jan. 25, 2019 (CN) ..... 2019 1 0073444

(51) Int. Cl.
*G09G 3/3258* (2016.01)

(52) U.S. Cl.
CPC ... *G09G 3/3258* (2013.01); *G09G 2300/0426* (2013.01); *G09G 2320/0257* (2013.01); *G09G 2330/028* (2013.01)

(58) Field of Classification Search
CPC ..... G09G 3/3233–3258
See application file for complete search history.

(56) References Cited

U.S. PATENT DOCUMENTS

2017/0270860 A1* 9/2017 Wang ..... G09G 3/3233
2018/0240400 A1* 8/2018 Zhou ..... G09G 3/325

* cited by examiner

*Primary Examiner* — Xuemei Zheng
(74) *Attorney, Agent, or Firm* — Brooks Kushman P.C.

(57) ABSTRACT

Disclosed are a pixel circuitry, a method for driving the same and a display device. The pixel circuitry includes a light-emitting element, a driving circuit, a compensation control circuit, an initialization circuit, an energy storage circuit, a writing control circuit and a light-emitting control circuit. The driving circuit is configured to drive the light-emitting element to emit light. The initialization circuit is configured to write an initialization voltage to a control end of the driving circuit to control the driving circuit to be turned on or off. The compensation control circuit is configured to turn on the driving circuit and perform threshold voltage compensation on the driving circuit. The writing control circuit is configured to write a data voltage inputted by a data line to a second end of the energy storage circuit and write a reference voltage to the second end of the energy storage circuit.

20 Claims, 3 Drawing Sheets

PIXEL CIRCUITRY, METHOD FOR DRIVING THE SAME AND DISPLAY DEVICE

CROSS-REFERENCE TO RELATED APPLICATION

This application claims priority to Chinese Patent Application No. 201910073444.0 filed on Jan. 25, 2019, which is incorporated herein by reference in its entirety.

TECHNICAL FIELD

The present disclosure relates to the field of display technology, and in particular to a pixel circuitry, a method for driving the pixel circuitry and a display device.

BACKGROUND

In an existing pixel circuitry, since threshold voltages for driving transistors have different deviations, a picture displayed on the entire display panel is uneven, and a compensation process is required to be performed on the threshold voltage. Due to a hysteresis effect of the driving transistor in the existing pixel circuitry, a problem of short-term afterimage exists in existing organic light-emitting diode (OLED) display products.

SUMMARY

In a first respect, an embodiment of the present disclosure provides a pixel circuitry, including: a light-emitting element, a driving circuit, a compensation control circuit, an initialization circuit, an energy storage circuit, a writing control circuit and a light-emitting control circuit; where a first end of the driving circuit is connected to a power voltage terminal, a second end of the driving circuit is connected to the light-emitting element through the light-emitting control circuit, a control end of the driving circuit is connected to a first end of the energy storage circuit, and the driving circuit is configured to drive the light-emitting element to emit light under the control of the control end of the driving circuit, the initialization circuit is configured to, under the control of an initial control signal inputted by an initial control line, write an initialization voltage to the control end of the driving circuit to control the driving circuit to be turned on or off, the compensation control circuit is configured to, under the control of a compensation control signal inputted by a compensation control line, turn on the driving circuit and perform threshold voltage compensation on the driving circuit, the writing control circuit is configured to: write a data voltage inputted by a data line to a second end of the energy storage circuit under the control of a gate driving signal inputted by a gate line, and write a reference voltage to the second end of the energy storage circuit under the control of a write control signal inputted by a writing control line, and the light-emitting control circuit is configured to enable electrical connection between the second end of the driving circuit and the light-emitting element under the control of a light-emitting control signal inputted by a light-emitting control line.

In some optional embodiments, the pixel circuitry further includes a reset circuit. The reset circuit is connected to the initial control line and the light-emitting element, and is configured to, under the control of the initial control signal inputted by the initial control line, supply the initialization voltage to a first electrode of the light-emitting element, to control the light-emitting element not to emit light. A second electrode of the light-emitting element is connected to a first voltage terminal.

In some optional embodiments, the initialization circuit includes an initialization transistor. A gate electrode of the initialization transistor is connected to the initial control line, a first electrode of the initialization transistor is connected to the control end of the driving circuit, and a second electrode of the initialization transistor is connected to an initialization voltage terminal for inputting the initialization voltage.

In some optional embodiments, the compensation control circuit includes a compensation control transistor. A gate electrode of the compensation control transistor is connected to the compensation control line, a first electrode of the compensation control transistor is connected to the second end of the driving circuit, and a second electrode of the compensation control transistor is connected to the control end of the driving circuit.

In some optional embodiments, the compensation control line is the gate line.

In some optional embodiments, the writing control circuit includes a data writing transistor and a reference voltage writing transistor. A gate electrode of the data writing transistor is connected to the gate line, a first electrode of the data writing transistor is connected to the data line, and a second electrode of the data writing transistor is connected to the second end of the energy storage circuit. A gate electrode of the reference voltage writing transistor is connected to the writing control line, a first electrode of the reference voltage writing transistor is connected to a reference voltage terminal for inputting the reference voltage, and a second electrode of the reference voltage writing transistor is connected to the second end of the energy storage circuit.

In some optional embodiments, the reference voltage terminal is the power voltage terminal.

In some optional embodiments, the light-emitting control circuit includes a light-emitting control transistor. A gate electrode of the light-emitting control transistor is connected to the light-emitting control line, a first electrode of the light-emitting control transistor is connected to the second end of the driving circuit, and a second electrode of the light-emitting control transistor is connected to a first electrode of the light-emitting element.

In some optional embodiments, the reset circuit includes a reset transistor. A gate electrode of the reset transistor is connected to the initial control line, a first electrode of the reset transistor is connected to an initialization voltage terminal, and a second electrode of the reset transistor is connected to the first electrode of the light-emitting element.

In some optional embodiments, the driving circuit includes a driving transistor, the energy storage circuit includes a storage capacitor, and the light-emitting element is an organic light-emitting diode. A gate electrode of the driving transistor is the control end of the driving circuit, a first electrode of the driving transistor is the first end of the driving circuit, and a second electrode of the driving transistor is the second end of the driving circuit. An anode of the organic light-emitting diode is a first electrode of the light-emitting element, and a cathode of the organic light-emitting diode is a second electrode of the light-emitting element.

In some optional embodiments, the initialization circuit is configured to, under the control of the initial control signal inputted by the initial control line, write the initialization voltage to the control end of the driving circuit to enable the first end and the second end of the driving circuit to be electrically connected.

In a second respect, a method for driving a pixel circuitry is further provided according to an embodiment of the present disclosure, which is applied to the pixel circuitry according to any one of embodiments described above, a display cycle of the pixel circuitry includes an initialization stage and a compensation stage. The method for driving the pixel circuitry includes:

inputting, in the initialization stage, the initial control signal to the initial control line to turn on the initialization circuit, and writing the initialization voltage to the control end of the driving circuit to turn on the driving circuit; and inputting, in the compensation stage, the gate driving signal to the gate line to turn on the writing control circuit, writing the data voltage to the second end of the energy storage circuit, and inputting the compensation control signal to the compensation control line to turn on the compensation control circuit to perform the threshold voltage compensation on the driving circuit.

In some optional embodiments, the method for driving a pixel circuitry further includes: inputting, in the initialization stage, the write control signal to the writing control line, to enable the writing control circuit to write the reference voltage to the second end of the energy storage circuit under the control of the write control signal.

In some optional embodiments, the display cycle further includes a display stage after the compensation stage; and the method for driving the pixel circuitry includes:

inputting, in the display stage, the write control signal to the writing control line, such that, under the control of the write control signal, the writing control circuit writes the reference voltage to the second end of the energy storage circuit to change a voltage of the control end of the driving circuit; and inputting the light-emitting control signal to the light-emitting control line to turn on the light-emitting control circuit, such that the driving circuit is electrically connected to the light-emitting element, and the driving circuit drives the light-emitting element to emit light based on a driving current.

In some optional embodiments, the pixel circuitry further includes a reset circuit; and the method for driving a pixel circuitry further includes: supplying, by the reset circuit in the initialization stage, under the control of the initial control signal, the initialization voltage to a first electrode of the light-emitting element to enable the light-emitting element not to emit light.

In some optional embodiments, the method for driving a pixel circuitry further includes: inputting, in the initialization stage and the compensation stage, a light-emitting control signal to the light-emitting control circuit, to enable the light-emitting control circuit to be turned off, in such a manner that the driving circuit and the light-emitting element are disconnected.

In a third respect, an embodiment of the present disclosure further provides a display device, including the pixel circuitry according to any one of the embodiments of the first respect.

DETAILED DESCRIPTION

Technical solutions of embodiments of the present disclosure will be described hereinafter in a clear and complete manner in conjunction with drawings of the embodiments of the present disclosure. The following embodiments are merely a part of, rather than all of, the embodiments of the present disclosure, based on the embodiments in the present disclosure, and all other embodiments obtained by those of ordinary skill in the art without creative labor shall fall within the protection scope of the present disclosure.

In a pixel circuitry in a related art, since threshold voltages of driving transistors have different deviations, a picture displayed on the entire display panel is uneven, so a compensation process is required to be performed in the threshold voltage. Furthermore, due to a hysteresis effect of the driving transistor in the pixel circuitry, for an OLED display product in the related art, a residual image occurs in a case that: a black-and-white picture is lighted for a period of time, and then the black-and-white picture is switched to be a gray-scale picture; and the residual image will disappear after a period of time, and the residual image is referred as a short-term residual image. The short-term residual image cannot be effectively eliminated in the related art.

In view of the above problems, the present disclosure provides a pixel circuitry, a method for driving a pixel circuitry and a display device, to solve a problem that threshold voltage compensation cannot be performed while the short-term residual image is effectively solved in the related art.

Transistors used in all embodiments of the present disclosure may be triodes, thin film transistors, or field effect transistors, or other devices with the same characteristics thereof. In an embodiment of the present disclosure, for each transistor, in order to distinguish two electrodes of the transistor except a control electrode, one electrode of the two electrodes is called a first electrode and the other electrode is called a second electrode.

In an actual operation, when the transistor is a triode, the control electrode may be a base electrode, the first electrode may be a collector electrode, and the second electrode may be an emitter electrode; or, the control electrode may be a base electrode, the first electrode may be an emitter electrode, and the second electrode may be a collector electrode.

In actual operation, when the transistor is a thin film transistor or a field effect transistor, the control electrode may be a gate electrode, the first electrode may be a drain electrode, and the second electrode may be a source electrode; or, the control electrode may be a gate electrode, the first electrode may be a source electrode, and the second electrode may be a drain electrode.

Figure 1:
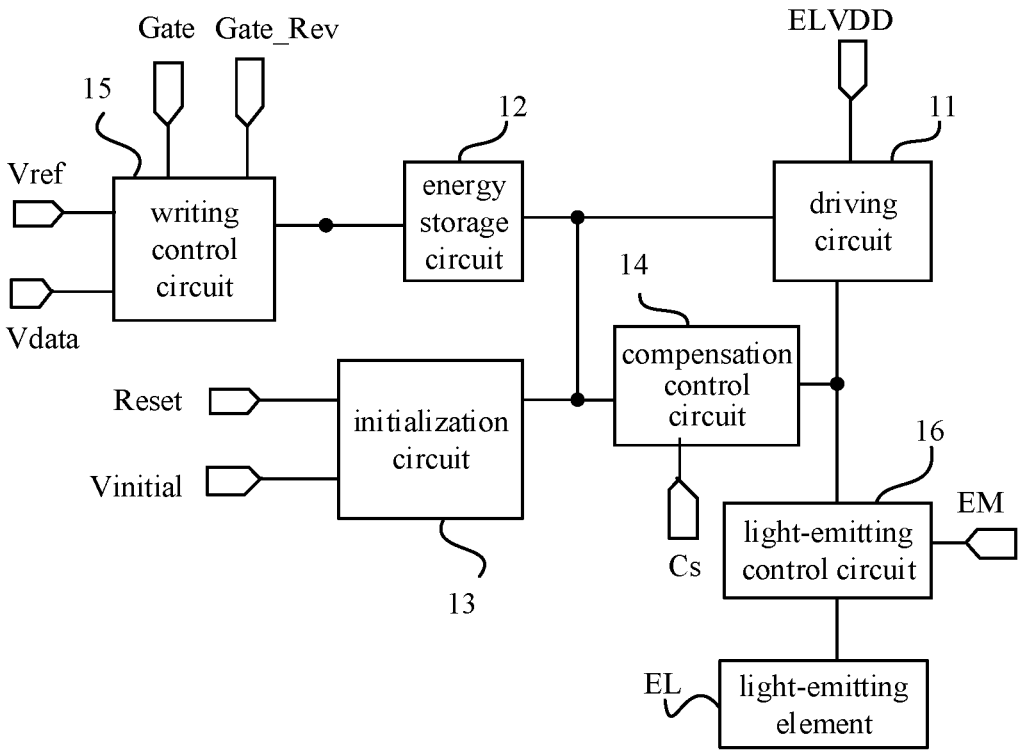
FIG. 1 is a structural block diagram of a pixel circuitry according to an embodiment of the present disclosure.

Reference is made to FIG. 1, which is a structural block diagram of a pixel circuitry according to an embodiment of the present disclosure. In an embodiment of the present disclosure, the pixel circuitry includes a light-emitting element EL, a driving circuit 11, an energy storage circuit 12, an initialization circuit 13, a compensation control circuit 14, a writing control circuit 15 and a light-emitting control circuit 16.

A first end of the driving circuit 11 is connected to a power voltage terminal for inputting a power supply voltage ELVDD, and a second end of the driving circuit 11 is connected to the light-emitting element EL through the light-emitting control circuit 16; and the driving circuit 11 is configured to drive the light-emitting element EL to emit light with a driving current under the control of a control end of the driving circuit 11.

A first end of the energy storage circuit 12 is connected to the control end of the driving circuit 11, and a second end of the energy storage circuit 12 is connected to the writing control circuit 15.

The initialization circuit 13 is respectively connected to an initial control line Reset, the control end of the driving circuit 11 and an initialization voltage terminal, and is configured to write the initialization voltage $V_{initial}$ to the control end of the driving circuit 11 under the control of an initial control signal inputted by the initial control line Reset, to reset the driving circuit 11. The initialization voltage terminal is configured to provide the initialization voltage $V_{initial}$.

The compensation control circuit 14 is connected to a compensation control line Cs, the control end of the driving circuit 11 and the second end of the driving circuit 11, and is configured to control the control end of the driving circuit 11 and the second end of the driving circuit 11 to be electrically connected under the control of a compensation control signal inputted by the compensation control line Cs, and is configured to perform threshold voltage compensation on the driving circuit under the control of the compensation control signal inputted by the compensation control line.

The writing control circuit 15 is connected to a gate line Gate, a data line, the second end of the energy storage circuit 12, a writing control line Gate_Rev, and a reference voltage terminal, and is configured to write a data voltage $V_{data}$ to the second end of the energy storage circuit 12 under the control of a gate driving signal outputted by the gate line GATE, and to write a reference voltage $V_{ref}$ to the second end of the energy storage circuit 12 under the control of a write control signal inputted by the writing control line Gate_Rev. The data voltage $V_{data}$ is inputted into the data line, and the reference voltage terminal is to input the reference voltage $V_{ref}$.

The light-emitting control circuit 16 is connected to a light-emitting control line EM, the second end of the driving circuit 11, and the light-emitting element EL, and is configured to the second end of the driving circuit 11 to be electrically connected to the light-emitting element EL under the control of a light-emitting control signal inputted by the light-emitting control line EM.

For the pixel circuitry described in the embodiment of the present disclosure, the initialization circuit 13 enables a potential of the control end of the driving circuit 11 to be set as the initialization voltage $V_{initial}$ in the initialization stage, so that a driving transistor included in the driving circuit 11 is turned on, i.e., in an on-bias state. In this way, regardless of whether a data voltage for displaying a picture in a previous frame corresponds to a black picture or a white picture, compensation and data writing processes are performed on the driving transistors included in the driving circuit 11 starting from the on-bias state. In an initialization stage included in each display cycle, a value of each of a gate voltage and a source voltage of the driving transistor included in the driving circuit 11 is fixed, thus ensuring the consistency of initialization, and solving the short-term afterimage problem due to a hysteresis effect. In addition, for the pixel circuitry according to the embodiment of the present disclosure, through the cooperation of the compensation control circuit 14, the light-emitting control circuit 16 and the writing control circuit 15, a threshold voltage of the driving transistor included in the driving circuit 11 can be compensated, thus solving the problem of uneven display of the display panel due to different threshold offsets of the driving transistor.

In an optional embodiment, when the pixel circuitry shown in FIG. 1 of the present disclosure is in operation, the display cycle includes an initialization stage, a compensation stage and a display stage sequentially arranged.

In the initialization stage, the initialization circuit 13 writes the initialization voltage $V_{initial}$ to the control end of the driving circuit 11 under the control of the initial control signal inputted through the initial control line Reset to control the driving circuit to be turned on or off; and the writing control circuit 15 writes the reference voltage $V_{ref}$ to the second end of the energy storage circuit 12 under the control of the write control signal inputted through the writing control line Gate_Rev. In such a manner, the second end of the energy storage circuit 12 is not in a floating state, and thus a voltage of the first end of the energy storage circuit 12 is not affected.

In the compensation stage, the writing control circuit 15 writes the data voltage $V_{data}$ to the second end of the energy storage circuit 12 under the control of the gate driving signal outputted by the gate line Gate; the compensation control circuit 14 controls the control end of the driving circuit 11 to be electrically connected to the second end of the driving circuit 11 under the control of the compensation control signal inputted by the compensation control line Cs, and the driving circuit 11 enable the electrical connection between the first end of the driving circuit 11 and the second end of the driving circuit 11 under the control of the control end of the driving circuit 11 such that the energy storage circuit 12 is charged through the power supply voltage ELVDD to boost a voltage of the control end of the driving circuit 11 until the voltage of the control end of the driving circuit 11 reaches ELVDD+$V_{th}$, and in this case, the driving transistor included in the driving circuit 11 is turned off.

In the initialization stage and the compensation stage, the light-emitting control circuit 16 enable the driving circuit 11 to be insulated from the light-emitting element EL under the control of the light-emitting control signal inputted by the light emission control line EM.

In the display stage, the writing control circuit 15 writes the reference voltage $V_{ref}$ to the second end of the energy storage circuit 12 under the control of the write control signal inputted by the writing control line Gate_Rev to change a voltage of the control end of the driving circuit 11 accordingly, the light-emitting control circuit 16 enable electrical connection between the driving circuit 11 and the light-emitting element EL under the control of the light-emitting control signal inputted by the light-emitting control line EM, and the driving circuit 11 drives the light-emitting element EL to emit light.

In some optional embodiments, the pixel circuitry may further include a reset circuit. The reset circuit is connected to the initial control line and the light-emitting element, and is configured to, under the control of the initial control signal inputted by the initial control line, supply the initialization voltage to a first electrode of the light-emitting element, to control the light-emitting element not to emit light. A second electrode of the light-emitting element is connected to a first voltage terminal.

The reset circuit is configured to provide an initialization voltage for the first electrode of the light-emitting element in the initialization stage, so that the light-emitting element does not to emit light, thereby ensuring that a residual charge of the first electrode of the light-emitting element does not affect display of the pixel circuitry.

In a specific implementation, the first voltage terminal may be a low voltage terminal, but is not limited thereto.

Figure 2:
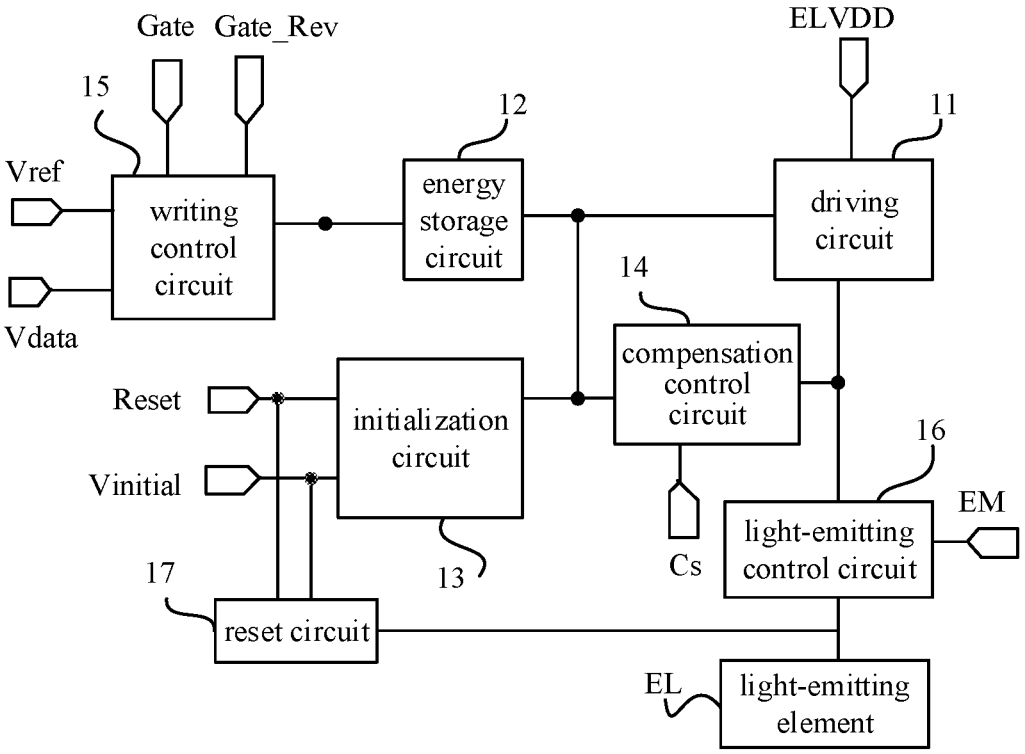
FIG. 2 is a structural block diagram of a pixel circuitry according to an embodiment of the present disclosure.

Reference is made to FIG. 2, which is a structural block diagram of a pixel circuitry designed on the basis of the embodiment of the pixel circuitry shown in FIG. 1 according to an embodiment of the present disclosure. The pixel circuitry further includes a reset circuit 17. The Reset circuit 17 is connected with the initial control line Reset, the first electrode of the light-emitting element EL, and the initialization voltage terminal, and is configured to supply an initialization voltage $V_{initial}$ to the first electrode of the light-emitting element EL under the control of the initial control signal inputted by the initial control line RESET, so that the light-emitting element EL does not to emit light. A second electrode of the light-emitting element EL is connected to a first voltage terminal VT 1.

In some optional embodiments, the initialization circuit may include an initialization transistor; and a control electrode of the initialization transistor is connected to the initial control line, a first electrode of the initialization transistor is connected to the control end of the driving circuit, and a second electrode of the initialization transistor is connected to an initialization voltage terminal, into which the initialization voltage is inputted.

In some optional embodiments, the compensation control circuit may include a compensation control transistor; and a control electrode of the compensation control transistor is connected to the compensation control line, a first electrode of the compensation control transistor is connected to the second end of the driving circuit, and a second electrode of the compensation control transistor is connected to the control end of the driving circuit.

In some optional embodiments, the compensation control line is the gate line, so as to reduce the number of signal lines as used.

In a specific implementation, the writing control circuit may include a data writing transistor and a reference voltage writing transistor. A control electrode of the data writing transistor is connected to the gate line, a first electrode of the data writing transistor is connected to the data line, and a second electrode of the data writing transistor is connected to the second end of the energy storage circuit. A control electrode of the reference voltage writing transistor is connected to the writing control line, a first electrode of the reference voltage writing transistor is connected to a reference voltage terminal for inputting the reference voltage, and a second electrode of the reference voltage writing transistor is connected to the second end of the energy storage circuit.

The reference voltage terminal is to input a reference voltage.

In some optional embodiments, the reference voltage terminal may be the power voltage terminal, so as to reduce the number of voltage terminals as used.

Specifically, the light-emitting control circuit may include a light-emitting control transistor. A control electrode of the light-emitting control transistor is connected to the light-emitting control line, a first electrode of the light-emitting control transistor is connected to the second end of the driving circuit, and a second electrode of the light-emitting control transistor is connected to a first electrode of the light-emitting element.

Specifically, the reset circuit may include a reset transistor. A control electrode of the reset transistor is connected to the initial control line, a first electrode of the reset transistor is connected to an initialization voltage terminal, and a second electrode of the reset transistor is connected to the first electrode of the light-emitting element.

In a practical operation, the driving circuit may include a driving transistor; the energy storage circuit may include a storage capacitor, and the light-emitting element may be an organic light-emitting diode. A gate electrode of the driving transistor is the control end of the driving circuit, a first electrode of the driving transistor is the first end of the driving circuit, and a second electrode of the driving transistor is the second end of the driving circuit. A first end of the storage capacitor is the first end of the energy storage circuit, and a second end of the storage capacitor is the second end of the energy storage circuit. An anode of the organic light-emitting diode is a first electrode of the light-emitting element, and a cathode of the organic light-emitting diode is a second electrode of the light-emitting element.

The pixel circuitry described in the present disclosure will be described below through a specific implementation.

Figure 3:
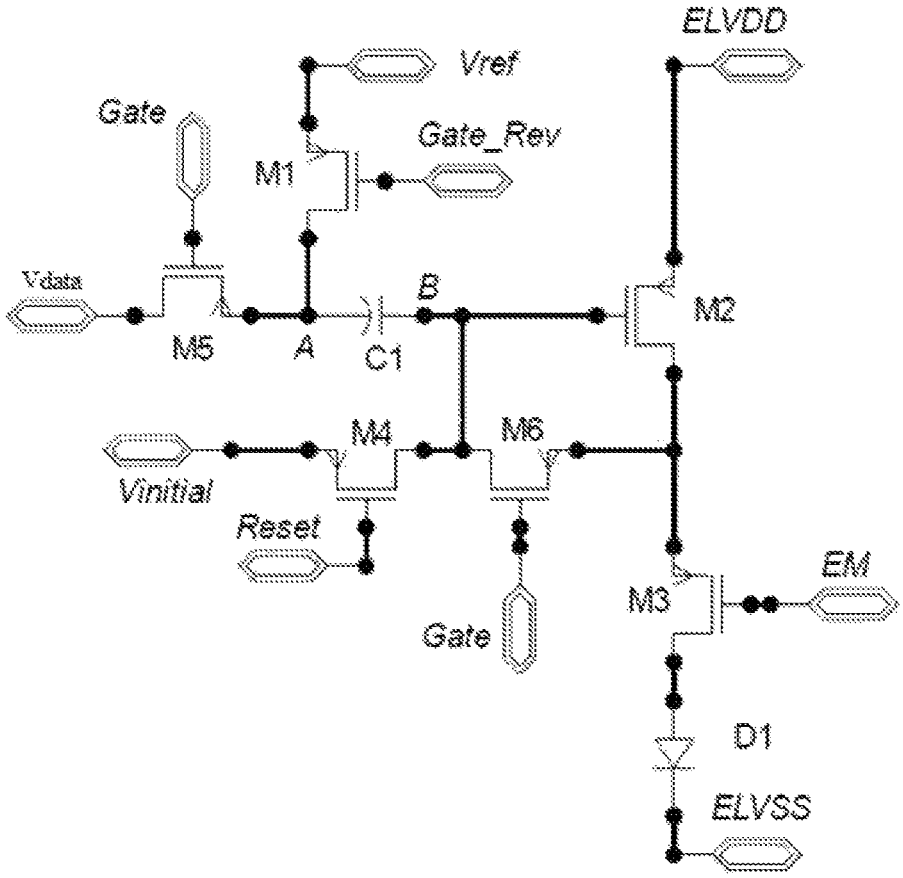
FIG. 3 is a circuit diagram of a pixel circuitry according to an embodiment of the present disclosure.

Reference is made to FIG. 3, which is a circuit diagram of a pixel circuitry according to an embodiment of the present disclosure; and the pixel circuitry includes an organic light-emitting diode D1, a driving circuit, an energy storage circuit, an initialization circuit, a compensation control circuit, a writing control circuit and a light-emitting control circuit.

The initialization circuit includes an initialization transistor M4; the compensation control circuit may include a compensation control transistor M6; the writing control circuit may include a data writing transistor M5 and a reference voltage writing transistor M1; the light-emitting control circuit includes a light-emitting control transistor M3; the driving circuit may include a driving transistor M2; and the energy storage circuit includes a storage capacitor C1. A first end of the storage capacitor C1 is connected to a gate electrode of the driving transistor M2, and a cathode of D1 is connected to a low voltage terminal for inputting a low voltage ELVSS. The source electrode of the driving transistor M2 is connected to a power voltage terminal for supplying a power supply voltage ELVDD.

A gate electrode of the initialization transistor M4 is connected to an initial control line Reset, a drain electrode of the initialization transistor M4 is connected to the gate electrode of the driving transistor M2, and a source electrode of the initialization transistor M4 is connected to an initialization voltage terminal. The initialization voltage terminal is configured to input an initialization voltage $V_{initial}$.

A gate electrode of the compensation control transistor M6 is connected to a gate line GATE, a source electrode of the compensation control transistor M6 is connected to a drain electrode of the driving transistor M2, and a drain electrode of the compensation control transistor M6 is connected to a gate line of the driving transistor M2.

A gate electrode of the data writing transistor M5 is connected to the gate line Gate, a drain electrode of the data writing transistor M5 is connected to a data line, and a source electrode of the data writing transistor M5 is connected to a second end of the storage capacitor C1. The data line is configured to supply a data voltage $V_{data}$.

A gate electrode of the reference voltage writing transistor M1 is connected to a writing control line Gate_Rev, a source electrode of the reference voltage writing transistor M1 is connected to a reference voltage terminal, and a drain electrode of the reference voltage writing transistor M1 is connected to the second end of the storage capacitor C1. The reference voltage terminal is to input a reference voltage $V_{ref}$.

A gate electrode of the light-emitting control transistor M3 is connected to a light-emitting control line EM, a source electrode of the light-emitting control transistor M3 is connected to the drain electrode of the driving transistor M2, and a drain electrode of the light-emitting control transistor M3 is connected to an anode of the organic light-emitting diode D1.

In FIG. 3, a first node connected to the first end of C1 is denoted as a reference number B, and a second node connected to the second end of C1 is denoted as a reference numeral A.

In the pixel circuitry shown in FIG. 3, all transistors are p-type transistors, but not limited thereto. Optionally, all the transistors in FIG. 3 can be designed as n-type transistors, as long as voltages inputted at each power voltage terminal and each signal input end is adjusted accordingly.

Figure 4:
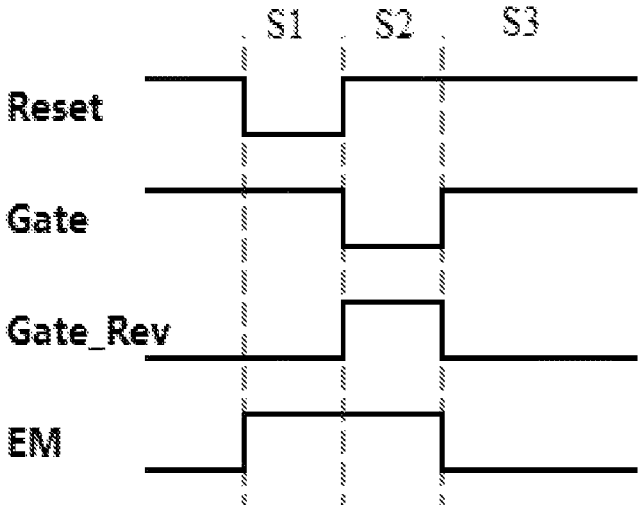
FIG. 4 is an operation sequence diagram of the pixel circuitry in FIG. 3 according to an embodiment of the present disclosure.

Reference is made to FIG. 4, which is an operation sequence diagram of the pixel circuitry shown in FIG. 3 according to the present disclosure. Each display cycle of the pixel circuitry shown in FIG. 3 includes an initialization stage S1, a compensation stage S2, and a display stage S3.

In the initialization stage S1, a low level is inputted into both the Reset and the Gate_Rev, and a high level is inputted into both the Gate and the EM. M4 is turned on due to the low level of Reset, the $V_{initial}$ is written to the gate electrode of the M2 to initialize the voltage of the gate electrode of the M2, such that the gate-source voltage of the M2 is $V_{initial}$−ELVDD, enabling the M2 in an on-bias state. In an initialization stage S1 included in each display cycle, the gate voltage of the M2 is $V_{initial}$, the source voltage of the M2 is ELVDD, thus ensuring the consistency of initialization and thus solving the short-term afterimage due to a hysteresis effect. Furthermore, the M1 is turned on due to the low level of Gate_Rev, so as to write $V_{ref}$ to the second node A to avoid an influence on a potential of the first end of the C1 due to the floating state of the second end of the C1.

It should be noted that the embodiment of the present disclosure only takes M2 in the on-bias state as an example to illustrate alleviation of the short-term afterimage problem, but is not limited thereto. In other embodiments, a level of $V_{initial}$ may also be controlled to enable the M2 is in an off-bias state, thus the gate-source voltage of the initialized driving transistor M2 is kept consistent, the short-term afterimage problem can be overcome to some extent.

In the compensation stage S2, a high level is inputted into all the Reset, the Gate_Rev and the EM, and a low level is inputted into the Gate. M5 and M6 are turned by the low level of the Gate, $V_{data}$ is written to the second node A through the M5, and the M2 is turned on. The ELVDD charges the C1 through the turned-on M2 and M6 to raise a voltage of the gate electrode of the M2 until the voltage of the gate electrode of the M2 becomes ELVDD+$V_{th}$. In this case, the M2 is turned off and the $V_{th}$ is the threshold voltage of the M2 and the threshold voltage $V_{th}$ of the M2 is written to the first node B.

In the display stage S3, the low level is inputted into both the Gate_Rev and the EM, and the high level is inputted into both the Reset and the Gate. The low level of the Gate_Rev turns the M1 on and the $V_{ref}$ is written to the second node A. According to the characteristics of the capacitor C1, the voltage of the first node B becomes ELVDD+$V_{th}$+($V_{ref}$−$V_{data}$). The low level of the EM turns on the M3, and the M2 is turned on to drive the D1 to emit light with the current of the M2, in this case, the gate-source voltage $V_{gs}$ of the M2 is $V_{ref}$+$V_{th}$−$V_{data}$, and the driving current I flowing through the M2 is as follows: $I=\frac{1}{2}\times k(V_{gs}-V_{th})^2=\frac{1}{2}\times k(V_{ref}-V_{data})^2$, where k is a current coefficient.

In view of the above, the pixel circuitry described in the embodiments of the present disclosure can realize threshold voltage compensation, so that the driving current is independent of the threshold voltage of the M2, and the problem of uneven display of the display panel due to different threshold offset of the driving transistor is solved.

In some alternative embodiments, in the pixel circuitry shown in FIG. 3, the reference voltage terminal may be the power voltage terminal, i.e., the source electrode of the M1 may be connected to the ELVDD, where the $V_{ref}$ is equal to the ELVDD, then $I=\frac{1}{2}K\times(ELVDD-V_{data})^2$, thus the above problem can be solved, while one signal line is reduced during wiring, thereby saving space and realizing a narrow frame.

The pixel circuitry shown in FIG. 3 includes six transistors. Compared with a pixel circuitry in the related art, the pixel circuitry in the FIG. 3 has fewer transistors, thereby facilitating realization of a narrow frame.

Figure 5:
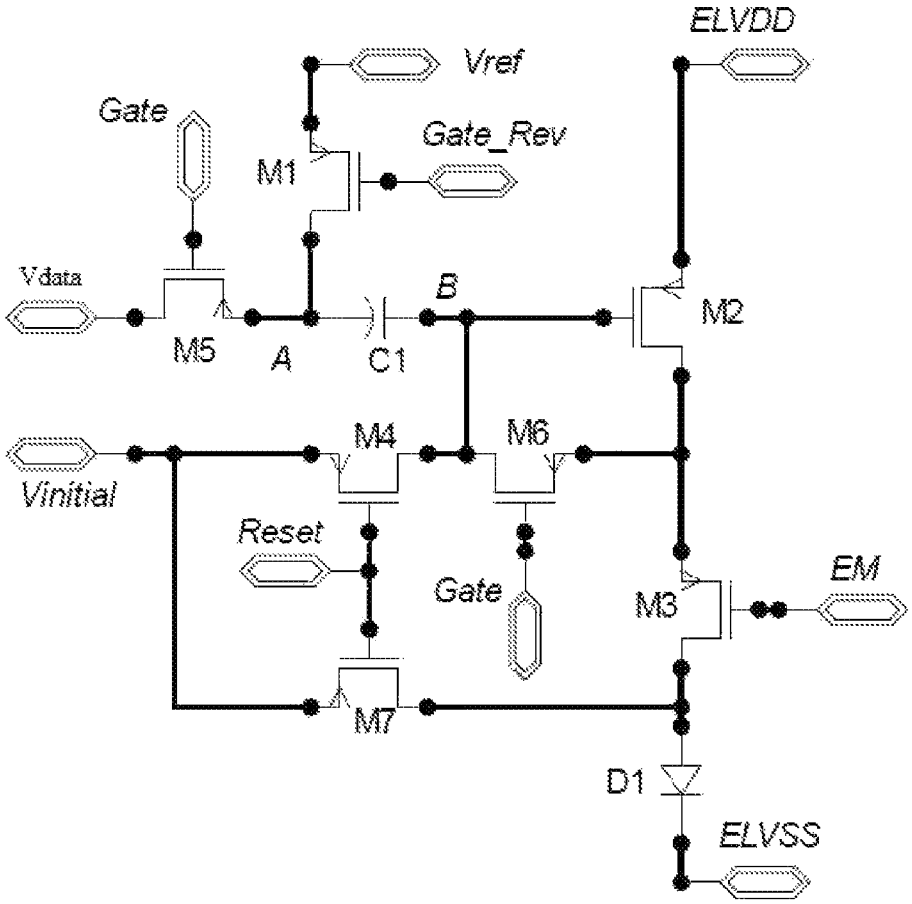
FIG. 5 is a circuit diagram of a pixel circuitry according to an embodiment of the present disclosure.

Reference is made to FIG. 5, which is a circuit diagram of a pixel circuitry according to an embodiment of the present disclosure; and on the basis of the pixel circuitry shown in FIG. 4, the pixel circuit shown in FIG. 5 further includes a reset circuit. The reset circuit includes a reset transistor M7. The gate electrode of the Reset transistor M7 is connected to the initial control line RESET, the source electrode of the reset transistor M7 is connected to the initialization voltage terminal, and the drain electrode of the reset transistor M7 is connected to the anode of the organic light-emitting diode D1. The initialization voltage terminal is used for inputting an initialization voltage $V_{initial}$.

In a specific embodiment shown in FIG. 5, the M7 is a p-type transistor, but is not limited thereto.

When the pixel circuitry shown in FIG. 5 is in operation, in the initialization stage S1, a low level is inputted into the Reset, and the M7 is turned on, to enable a voltage of the anode of the D1 to be $V_{initial}$, so that the D1 does not to emit light and an influence of a residual charge in the anode of the D1 on display of the pixel circuitry can be avoided.

Figure 6:
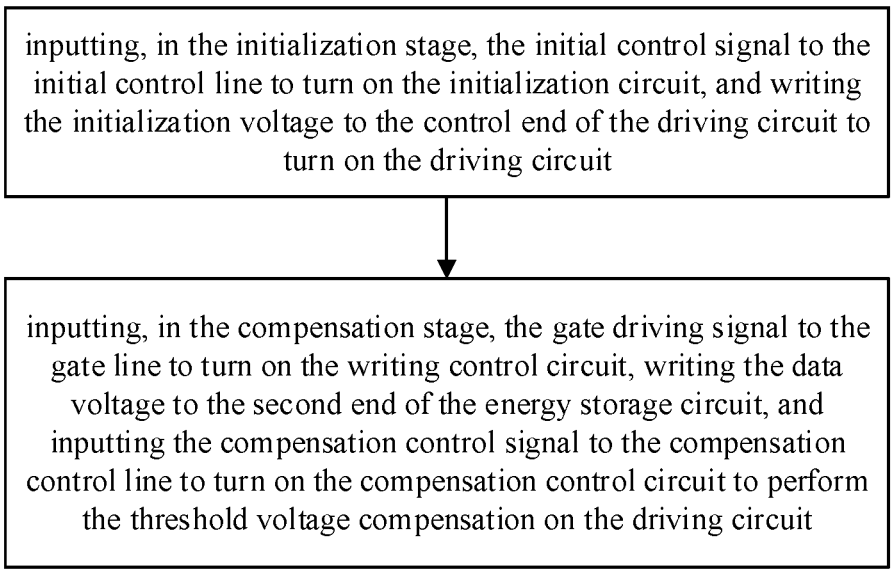
FIG. 6 is a flowchart of a method for driving a pixel circuitry according to an embodiment of the present disclosure.

Reference is made to FIG. 6, which is a flowchart of a method for driving a pixel circuitry according to an embodiment of the present disclosure. The method for driving a pixel circuitry is applied to the pixel circuitry described above, and each display cycle of the pixel circuitry includes an initialization stage and a compensation stage sequentially arranged; and the method for driving the pixel circuitry includes:

in the initialization stage, inputting the initial control signal to the initial control line to turn on the initialization circuit, and writing the initialization voltage to the control end of the driving circuit to turn on the driving circuit; and in the compensation stage, inputting the gate driving signal to the gate line to turn on the writing control circuit, writing the data voltage to the second end of the energy storage circuit, and inputting the compensation control signal to the compensation control line to turn on the compensation control circuit to perform the threshold voltage compensation on the driving circuit.

For the method for driving the pixel circuitry described in the embodiments of the present disclosure, in the initialization stage, a voltage at the control end of the driving circuit is initialized so that the driving transistor included in the driving circuit is in an on-bias state, such that regardless of whether a data voltage for displaying a picture in a previous frame corresponds to a black picture or a white picture, compensation and data writing processes are performed on the driving transistors included in the driving circuit starting from the on-bias state. In an initialization stage included in each display cycle, a value of each of a gate voltage and a source voltage of the driving transistor included in the driving circuit is fixed, thus ensuring the consistency of initialization and solving the short-term afterimage problem due to a hysteresis effect. In addition, in the embodiments of the disclosure, the threshold of the driving transistor included in the driving circuit is compensated through the cooperation of the compensation control circuit, the light-emitting control circuit and the writing control circuit, so that the driving current of the driving transistor is independent of the threshold voltage thereof, and a problem of uneven display of the display panel due to different threshold offset of the driving transistor can be solved.

In some optional embodiments, the method for driving a pixel circuitry of the present disclosure may further include: in the initialization stage, inputting the write control signal to the writing control line, to enable the writing control circuit to write the reference voltage to the second end of the energy storage circuit under the control of the write control signal.

In the initialization stage, the writing control circuit writes the reference voltage $V_{ref}$ to the second end of the energy storage circuit under the control of the write control signal inputted through the writing control line, so as to prevent the second end of the energy storage circuit from floating and further to prevent the floated second end of the energy storage circuit from affecting the voltage of the first end of the energy storage circuit.

In some optional embodiments, the display cycle may further include a display stage after the compensation stage; and the method for driving the pixel circuitry includes:

inputting, in the display stage, the write control signal to the writing control line, such that, under the control of the write control signal, the writing control circuit writes the reference voltage to the second end of the energy storage circuit to change a voltage of the control end of the driving circuit; and inputting the light-emitting control signal to the light-emitting control line to turn on the light-emitting control circuit, such that the driving circuit is electrically connected to the light-emitting element, and the driving circuit drives the light-emitting element to emit light based on a driving current.

In some optional embodiments, the pixel circuitry further includes a reset circuit; and the method for driving the pixel circuitry further includes: in the initialization stage, supplying, by the reset circuit, under the control of the initial control signal, the initialization voltage to a first electrode of the light-emitting element so as to enable the light-emitting element not to emit light.

In the initialization stage, the reset circuit provides an initialization voltage for the first electrode of the light-emitting element, such that the light-emitting element does not to emit light, and thus residual electric charges of the first electrode of the light-emitting element does not affect display quality.

In some optional embodiments, the method for driving the pixel circuitry further includes: inputting, in the initialization stage and the compensation stage, a light-emitting control signal to the light-emitting control circuit, to enable the light-emitting control circuit to be turned off, in such a manner that the driving circuit and the light-emitting element are disconnected.

A display device is further provided according to an embodiment of the present disclosure, which includes the pixel circuitry described above.

The display device according to the embodiments of the disclosure can be any product or component with a display function, such as a mobile phone, a tablet computer, a television, a display, a notebook computer, a digital photo frame, a navigator and the like.

The above embodiments are merely optional embodiments of the present disclosure. It should be noted that numerous improvements and modifications may be made by those skilled in the art without departing from the principle of the present disclosure, and these improvements and modifications shall also fall within the scope of the present disclosure.

What is claimed is:

1. A pixel circuitry, comprising:

a light-emitting element, a driving circuit, a compensation control circuit, an initialization circuit, an energy storage circuit, a writing control circuit and a light-emitting control circuit;

where a first end of the driving circuit is connected to a power voltage terminal, a second end of the driving circuit is connected to the light-emitting element through the light-emitting control circuit, a control end of the driving circuit is connected to a first end of the energy storage circuit, and the driving circuit is configured to drive the light-emitting element to emit light under the control of the control end of the driving circuit, the initialization circuit is configured to, under the control of an initial control signal inputted by an initial control line, write an initialization voltage to the control end of the driving circuit to control the driving circuit to be turned on or off, the compensation control circuit is configured to, under the control of a compensation control signal inputted by a compensation control line, turn on the driving circuit and perform threshold voltage compensation on the driving circuit, the writing control circuit is configured to: write a data voltage inputted by a data line to a second end of the energy storage circuit under the control of a gate driving signal inputted by a gate line, and write a reference voltage to the second end of the energy storage circuit under the control of a write control signal inputted by a writing control line, and the light-emitting control circuit is configured to enable the second end of the driving circuit to be electrically connected to the light-emitting element under the control of a light-emitting control signal inputted by a light-emitting control line, wherein the writing control circuit comprises a data writing transistor and a reference voltage writing transistor;

a gate electrode of the data writing transistor is connected to the gate line, a first electrode of the data writing transistor is connected to the data line, and a second electrode of the data writing transistor is connected to the second end of the energy storage circuit; and a gate electrode of the reference voltage writing transistor is connected to the writing control line, a first electrode of the reference voltage writing transistor is connected to a reference voltage terminal for inputting the reference voltage, and a second electrode of the reference voltage writing transistor is connected to the second end of the energy storage circuit, wherein the reference voltage terminal is the power voltage terminal.

2. The pixel circuitry according to claim 1, further comprising a reset circuit; wherein the reset circuit is connected to the initial control line and the light-emitting element, and is configured to, under the control of the initial control signal inputted by the initial control line, supply the initialization voltage to a first electrode of the light-emitting element, to control the light-emitting element not to emit light; and a second electrode of the light-emitting element is connected to a first voltage terminal.

3. The pixel circuitry according to claim 2, wherein the reset circuit comprises a reset transistor; and a gate electrode of the reset transistor is connected to the initial control line, a first electrode of the reset transistor is connected to an initialization voltage terminal, and a second electrode of the reset transistor is connected to the first electrode of the light-emitting element.

4. The pixel circuitry according to claim 2, wherein the initialization circuit comprises an initialization transistor; and a gate electrode of the initialization transistor is connected to the initial control line, a first electrode of the initialization transistor is connected to the control end of the driving circuit, and a second electrode of the initialization transistor is connected to an initialization voltage terminal for inputting the initialization voltage.

5. The pixel circuitry according to claim 2, wherein the compensation control circuit comprises a compensation control transistor; and a gate electrode of the compensation control transistor is connected to the compensation control line, a first electrode of the compensation control transistor is connected to the second end of the driving circuit, and a second electrode of the compensation control transistor is connected to the control end of the driving circuit.

6. The pixel circuitry according to claim 2, wherein the writing control circuit comprises a data writing transistor and a reference voltage writing transistor;

a gate electrode of the data writing transistor is connected to the gate line, a first electrode of the data writing transistor is connected to the data line, and a second electrode of the data writing transistor is connected to the second end of the energy storage circuit; and a gate electrode of the reference voltage writing transistor is connected to the writing control line, a first electrode of the reference voltage writing transistor is connected to a reference voltage terminal for inputting the reference voltage, and a second electrode of the reference voltage writing transistor is connected to the second end of the energy storage circuit.

7. The pixel circuitry according to claim 1, wherein the initialization circuit comprises an initialization transistor; and a gate electrode of the initialization transistor is connected to the initial control line, a first electrode of the initialization transistor is connected to the control end of the driving circuit, and a second electrode of the initialization transistor is connected to an initialization voltage terminal for inputting the initialization voltage.

8. The pixel circuitry according to claim 1, wherein the compensation control circuit comprises a compensation control transistor; and a gate electrode of the compensation control transistor is connected to the compensation control line, a first electrode of the compensation control transistor is connected to the second end of the driving circuit, and a second electrode of the compensation control transistor is connected to the control end of the driving circuit.

9. The pixel circuitry according to claim 1, wherein the compensation control line is the gate line.

10. The pixel circuitry according to claim 1, wherein the light-emitting control circuit comprises a light-emitting control transistor; and a gate electrode of the light-emitting control transistor is connected to the light-emitting control line, a first electrode of the light-emitting control transistor is connected to the second end of the driving circuit, and a second electrode of the light-emitting control transistor is connected to a first electrode of the light-emitting element.

11. The pixel circuitry according to claim 1, wherein the driving circuit comprises a driving transistor, the energy storage circuit comprises a storage capacitor, and the light-emitting element is an organic light-emitting diode;

a gate electrode of the driving transistor is the control end of the driving circuit, a first electrode of the driving transistor is the first end of the driving circuit, and a second electrode of the driving transistor is the second end of the driving circuit; and an anode of the organic light-emitting diode is a first electrode of the light-emitting element, and a cathode of the organic light-emitting diode is a second electrode of the light-emitting element.

12. The pixel circuitry according to claim 1, wherein the initialization circuit is configured to, under the control of the initial control signal inputted by the initial control line, write the initialization voltage to the control end of the driving circuit to enable the first end and the second end of the driving circuit to be electrically connected.

13. A method for driving a pixel circuitry, applied to the pixel circuitry according to claim 1, wherein a display cycle of the pixel circuitry comprises an initialization stage and a compensation stage; and the method for driving a pixel circuitry comprises:

inputting, in the initialization stage, the initial control signal to the initial control line to turn on the initialization circuit, writing the initialization voltage to the control end of the driving circuit to turn on the driving circuit, and inputting the write control signal to the writing control line, to enable the writing control circuit to write the reference voltage to the second end of the energy storage circuit under the control of the write control signal; and inputting, in the compensation stage, the gate driving signal to the gate line to turn on the writing control circuit, writing the data voltage to the second end of the energy storage circuit, and inputting the compensation control signal to the compensation control line to turn on the compensation control circuit to perform the threshold voltage compensation on the driving circuit.

14. The method according to claim 13, wherein the display cycle further comprises a display stage after the compensation stage; and the method comprises:

inputting, in the display stage, the write control signal to the writing control line, such that, under the control of the write control signal, the writing control circuit writes the reference voltage to the second end of the energy storage circuit to change a voltage of the control end of the driving circuit; and inputting the light-emitting control signal to the light-emitting control line to turn on the light-emitting control circuit, such that the driving circuit is electrically connected to the light-emitting element, and the driving circuit drives the light-emitting element to emit light based on a driving current.

15. The method according to claim 13, wherein the pixel circuitry further comprises a reset circuit; and the method further comprises:

supplying, by the reset circuit in the initialization stage, under the control of the initial control signal, the initialization voltage to a first electrode of the light-emitting element to enable the light-emitting element not to emit light.

16. The method according to claim 13, further comprising:

inputting, in the initialization stage and the compensation stage, a light-emitting control signal to the light-emitting control circuit, to enable the light-emitting control circuit to be turned off, in such a manner that the driving circuit and the light-emitting element are disconnected.

17. A display device, comprising the pixel circuitry according to claim 1.

18. A method for driving a pixel circuitry, wherein a display cycle of the pixel circuitry comprises an initialization stage and a compensation stage;

wherein the pixel circuitry comprises:

a light-emitting element, a driving circuit, a compensation control circuit, an initialization circuit, an energy storage circuit, a writing control circuit and a light-emitting control circuit;

where a first end of the driving circuit is connected to a power voltage terminal, a second end of the driving circuit is connected to the light-emitting element through the light-emitting control circuit, a control end of the driving circuit is connected to a first end of the energy storage circuit, and the driving circuit is configured to drive the light-emitting element to emit light under the control of the control end of the driving circuit, the initialization circuit is configured to, under the control of an initial control signal inputted by an initial control line, write an initialization voltage to the control end of the driving circuit to control the driving circuit to be turned on or off, the compensation control circuit is configured to, under the control of a compensation control signal inputted by a compensation control line, turn on the driving circuit and perform threshold voltage compensation on the driving circuit, the writing control circuit is configured to: write a data voltage inputted by a data line to a second end of the energy storage circuit under the control of a gate driving signal inputted by a gate line, and write a reference voltage to the second end of the energy storage circuit under the control of a write control signal inputted by a writing control line, and the light-emitting control circuit is configured to enable the second end of the driving circuit to be electrically connected to the light-emitting element under the control of a light-emitting control signal inputted by a light-emitting control line, wherein the method for driving a pixel circuitry comprises:

inputting, in the initialization stage, the initial control signal to the initial control line to turn on the initialization circuit, writing the initialization voltage to the control end of the driving circuit to turn on the driving circuit, and inputting the write control signal to the writing control line, to enable the writing control circuit to write the reference voltage to the second end of the energy storage circuit under the control of the write control signal; and inputting, in the compensation stage, the gate driving signal to the gate line to turn on the writing control circuit, writing the data voltage to the second end of the energy storage circuit, and inputting the compensation control signal to the compensation control line to turn on the compensation control circuit to perform the threshold voltage compensation on the driving circuit.

19. The method according to claim 18, wherein the display cycle further comprises a display stage after the compensation stage; and the method comprises:

inputting, in the display stage, the write control signal to the writing control line, such that, under the control of the write control signal, the writing control circuit writes the reference voltage to the second end of the energy storage circuit to change a voltage of the control end of the driving circuit; and inputting the light-emitting control signal to the light-emitting control line to turn on the light-emitting control circuit, such that the driving circuit is electrically connected to the light-emitting element, and the driving circuit drives the light-emitting element to emit light based on a driving current.

20. The method according to claim 18, wherein the pixel circuitry further comprises a reset circuit; and the method further comprises:

supplying, by the reset circuit in the initialization stage, under the control of the initial control signal, the initialization voltage to a first electrode of the light-emitting element to enable the light-emitting element not to emit light.

* * * * *